US006997791B2

(12) United States Patent
Lee

(10) Patent No.: US 6,997,791 B2
(45) Date of Patent: Feb. 14, 2006

(54) CMP POLISHING HEADS AND METHODS OF USING THE SAME

(75) Inventor: Jin Kyu Lee, Bucheon-si (KR)

(73) Assignee: DongbuAnam Semiconductor, Inc., Seoul (KR)

( * ) Notice: Subject to any disclaimer, the term of this patent is extended or adjusted under 35 U.S.C. 154(b) by 0 days.

(21) Appl. No.: 10/889,344

(22) Filed: Jul. 12, 2004

(65) Prior Publication Data

US 2005/0009453 A1 Jan. 13, 2005

(30) Foreign Application Priority Data

Jul. 12, 2003 (KR) ..... 10-2003-0047495

(51) Int. Cl.
*B24B 5/00* (2006.01)
*B24B 29/00* (2006.01)

(52) U.S. Cl. ..... 451/287; 451/289

(58) Field of Classification Search ..... 451/289, 451/41, 59, 63, 279, 287, 288, 388
See application file for complete search history.

(56) References Cited

U.S. PATENT DOCUMENTS

| | | | | |
|---|---|---|---|---|
| 5,803,799 | A | 9/1998 | Volodarsky et al. | |
| 5,980,361 | A * | 11/1999 | Muller et al. | 451/9 |
| 6,113,480 | A * | 9/2000 | Hu et al. | 451/289 |
| 6,245,193 | B1 | 6/2001 | Quek et al. | |
| 6,336,846 | B1 | 1/2002 | Park et al. | |
| 6,612,903 | B1 * | 9/2003 | Korovin et al. | 451/9 |
| 6,764,387 | B1 * | 7/2004 | Chen | 451/41 |
| 6,769,966 | B1 * | 8/2004 | Okamura et al. | 451/53 |
| 6,769,973 | B1 * | 8/2004 | Boo et al. | 451/289 |

* cited by examiner

*Primary Examiner*—Jacob K. Ackun, Jr.
(74) *Attorney, Agent, or Firm*—Hanley, Flight & Zimmerman, LLC

(57) ABSTRACT

Polishing heads to polish the surface of a semiconductor wafer and methods of using the same are disclosed. A disclosed polishing head includes at least one rotating head to apply a downward force; and a plurality of vacuum cells to hold the wafer via a vacuum force and to convey a least some of the downward force from the at least one rotating head to the wafer.

6 Claims, 5 Drawing Sheets

CMP POLISHING HEADS AND METHODS OF USING THE SAME

FIELD OF THE DISCLOSURE

The present disclosure relates generally to semiconductor fabrication and, more particularly, to CMP polishing heads and method of using the same.

BACKGROUND

As the integration of semiconductor devices increases, multi-layer interconnection technology has been put into practical use. Thus, local and global area planarization of an interlayer insulating layer has become important. A widely used CMP (Chemical Mechanical Polishing) method of polishing the surface of a semiconductor wafer employs chemical components contained in a slurry solution, a polishing pad, and a polishing agent.

A CMP apparatus is most frequently used to polish the front face of a semiconductor wafer in fabricating semiconductor devices on the wafer. Generally, a wafer is planarized or softened at least one time during the fabricating process in order to make the surface of the wafer as flat as possible. In order to polish the wafer, the wafer is placed on a carrier, put into contact with a polishing pad covered with slurry and then pressed. Wafer polishing is then carried out by rotating the polishing pad and the wafer-loaded carrier.

A prior art CMP apparatus for polishing a wafer includes a polishing platen, a polishing pad located over the polishing platen, a polishing head, and a retainer ring and/or membrane for holding the wafer in the bottom edge of the polishing head. The wafer is held in the retainer ring so that the surface of the wafer to be polished is disposed toward the polishing pad. The retainer ring has multiple grooves to facilitate the flow of polishing slurry to the surface of the wafer. The grooves are extended from the inner to the outer surface of the retainer ring. Each groove has a round shape structure.

We will now look at the way in which the retainer ring and polishing pad are used in the prior art. To this end, FIG. 1*a* through FIG. 1*c* are schematic, cross-sectional, views which illustrate a retainer ring of a prior art polishing head. FIG. 1*a* is a schematic, cross-sectional, view illustrating the structure of a prior art CMP polishing head 18 for polishing the surface of a wafer. FIG. 1*b* and FIG. 1*c* are schematic, cross-sectional, views which illustrate the retainer ring 14. FIG. 1*c* is a cross-sectional view of the channels 16 of the retainer ring 14 depicted in FIG. 1*b*.

Referring to FIG. 1*a*, the prior art CMP apparatus has a polishing pad 10 which is covered with the flow of polishing slurry. It also has a polishing head 18. The wafer 12 is positioned between the polishing pad 10 and the polishing head 18. A retainer ring 14 is disposed at the bottom edge of the polishing head 18. The retainer ring 14 holds the wafer 12 to prevent it from being derailed during the CMP process. The retainer ring 14 of the polishing head 18 has multiple grooves 16 to facilitate the flow of polishing slurry. The grooves 16 are extended from the inner surface of the retainer ring 14 to the outer surface of the retainer ring 14. The slurry flows uniformly on the surface of the wafer 12, since the grooves 16 act as passing channels to facilitate the flow of polishing slurry.

FIG. 1*b* is a cross-sectional bottom view of the retainer ring 14. As mentioned above, the retainer ring 14 has multiple grooves 16 which extend from its inner surface to its outer surface. As shown in FIG. 1*b*, the grooves 16 are circularly shaped and skewed at a predetermined angle toward the outer rim against the rotating direction of the retainer ring 14. During a polishing process, the retainer ring 14 rotates with the desired speed and provides the whole area of the wafer 12 with a uniform flow of the polishing slurry through the grooves 16.

As shown in FIG. 1*c*, the cross-sections of the channels 16 have a round shape 16*a*. Thus, the channels 16 facilitate the smooth flow of polishing slurry over the surface of the wafer in comparison with the rectangular shape of grooves sometimes employed in the prior art. The worn amount of the polishing pad may be reduced by preventing fast sticking of the polishing pad, so that the durability of the pad can be increased.

Conventional CMP polishing heads have employed consumables such as a retainer ring or membrane, but these consumables cause a huge increase in maintenance costs.

Volodarsky et al., U.S. Pat. No. 5,803,799, describes a polishing head for polishing a semiconductor wafer. The polishing head includes a housing, a wafer carrier movably mounted to the housing, and a wafer retainer movably mounted to the housing.

Quek et al., U.S. Pat. No. 6,245,193, describes a substrate carrier head for use in a CMP apparatus.

Park et al., U.S. Pat. No. 6,336,846, describes a chemical-mechanical polishing (CMP) apparatus having a polishing head onto which a semiconductor wafer is fixed for holding the surface of the semiconductor wafer in contact with the surface of a polishing pad.

DETAILED DESCRIPTION

Figure 1A:
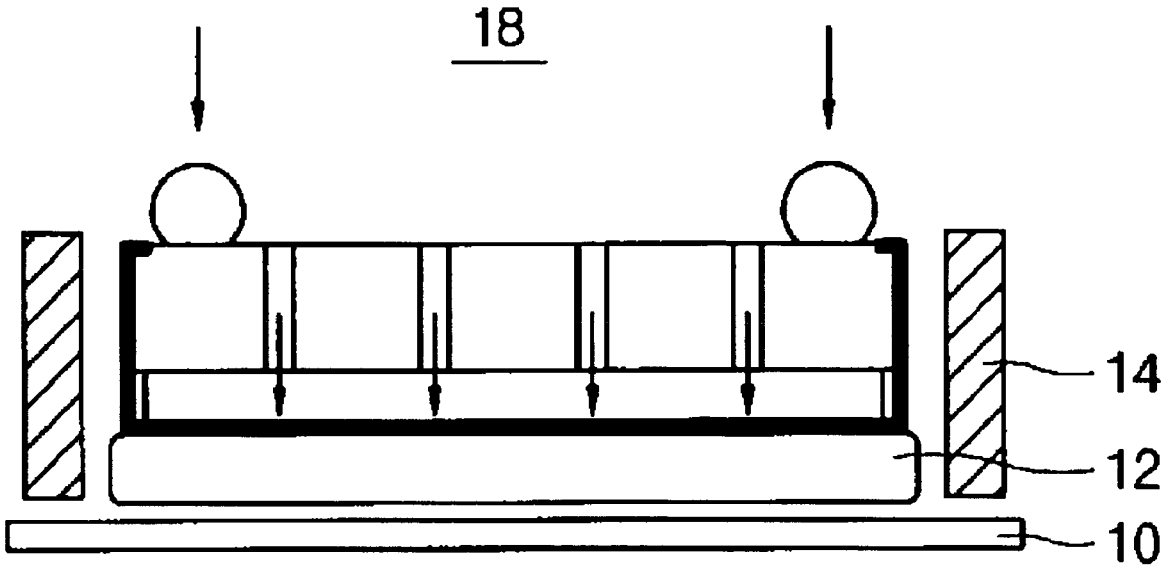
FIG. 1*a* through FIG. 1*c* are cross-sectional views which schematically illustrate the retainer ring of a prior art polishing head.
Figure 1B:
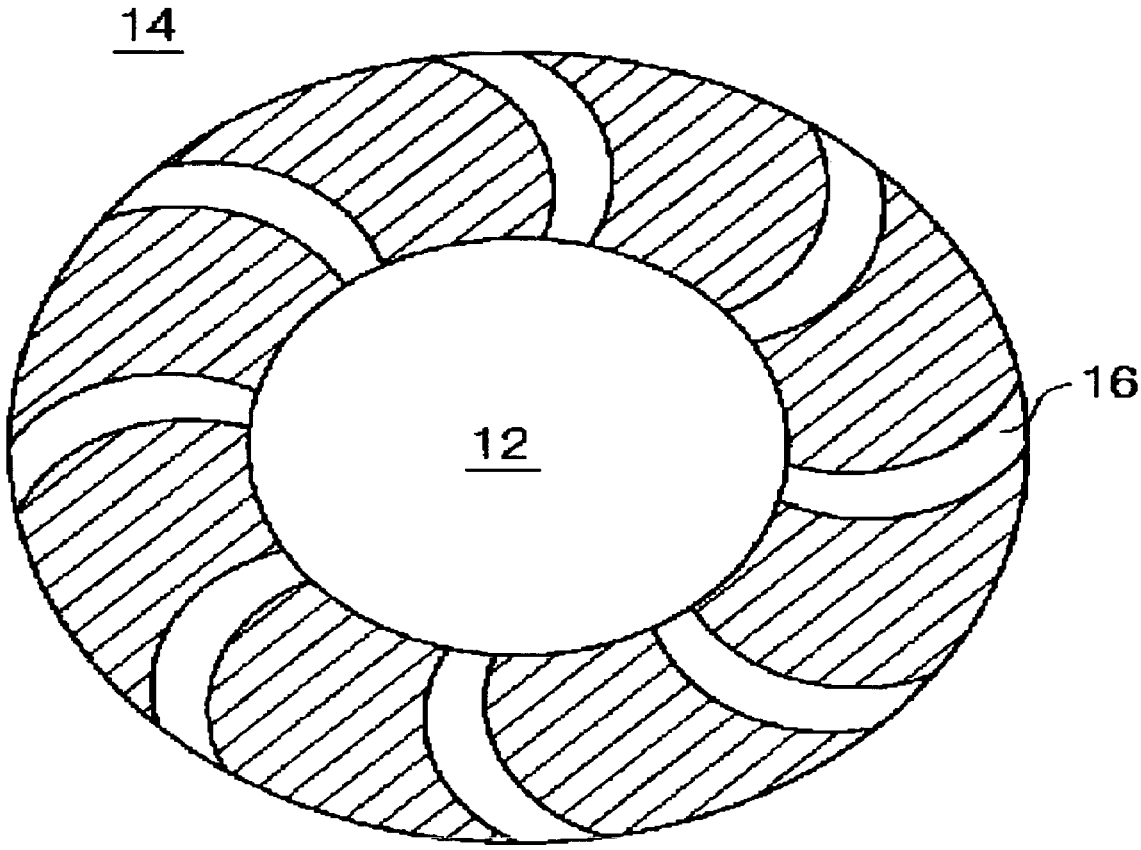
Figure 1C:
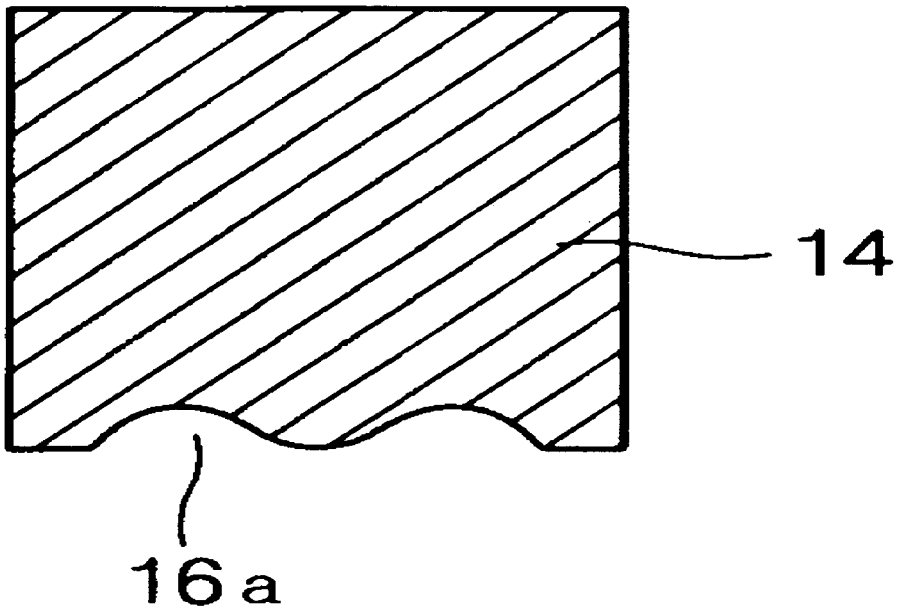
Figure 2A:
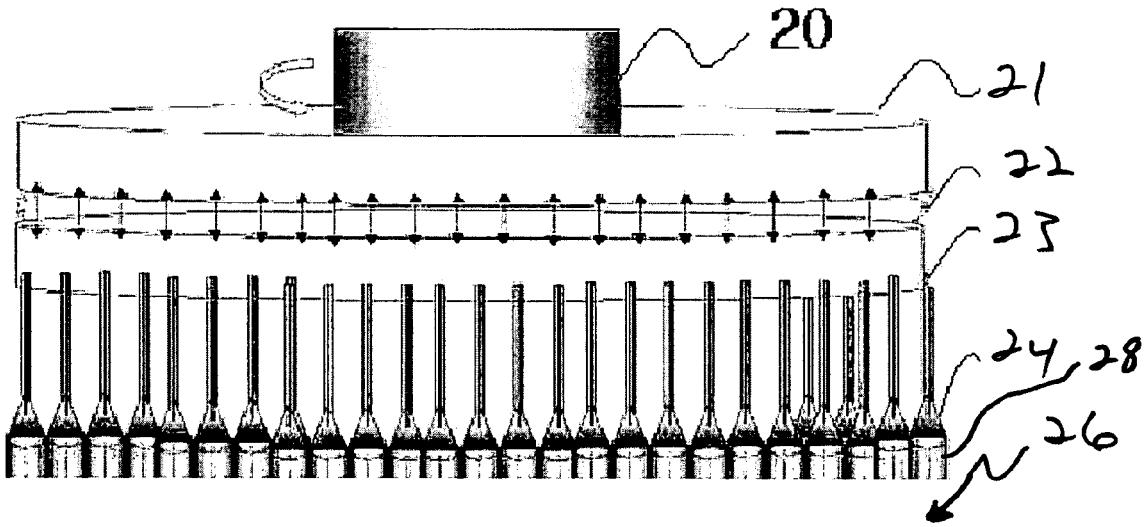
FIG. 2*a* through FIG. 2*e* are cross-sectional views which schematically illustrate an example CMP polishing head.

FIG. 2*a* schematically illustrates an example polishing head for polishing the surface of a wafer. The example polishing head of FIG. 2*a* is connected with a rotating axis 20. The polishing head comprises a first rotating head 21, a second rotating head 23, an air bag 22, and a plurality of wafer holding cells 28. The first rotating head 21 rotates and applies a downward force 30. The second rotating head 23 is installed under the first rotating head 21. The air bag 22 delivers the downward force 30 from the first rotating head 21 to the second rotating head 23, and is positioned between the first and the second rotating head 21, 23. The plurality of wafer holding cells 28 conveys the downward force 30 delivered from the second rotating head 23 to the wafer 26. The wafer 26 is held in place by a vacuum method as explained further below. The plurality of wafer holding cells 28 is located under the second rotating head 23.

Conventional CMP polishing heads have held and released the wafer by employing either a retainer ring and membrane or a vacuum method employing a hole. However, the CMP polishing processes disclosed herein are carried out while holding the wafer 26 with a plurality of wafer holding cells 28 distributed throughout the whole area of the backside of the wafer 26. Each wafer holding cell 28 has a vacuum line 24 and applies a vacuum force to the wafer.

Figure 2B:
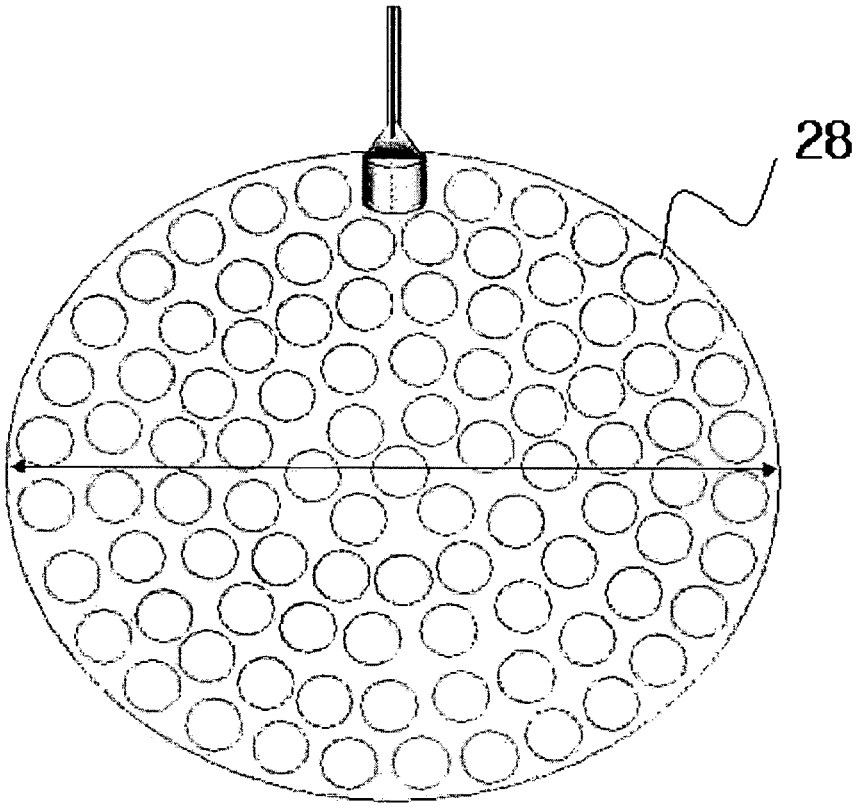

FIG. 2*b* schematically illustrates an example wafer holding cell 28. Referring to FIG. 2*b*, the wafer holding cell 28 assists in holding the wafer 26 to prevent the wafer 26 from being derailed during a CMP process. The holding end of the wafer holding cell 28 has a wider area than its opposite end. The wafer holding cells 28 have a funnel shape and have a substantially circular cross-section through the funnel shape.

Figure 2C:
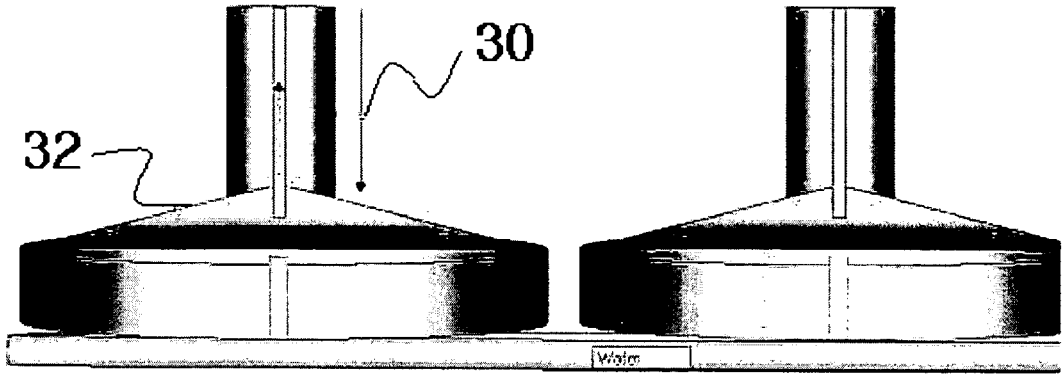

FIG. 2*c* is a schematic, horizontal view of the example CMP polishing head of FIG. 2*a*. A method for operating a CMP polishing head of FIG. 2*a* comprises: holding a wafer by vacuum force with a plurality of wafer holding cells, wherein each of the wafer holding cells comprises a vacuum line and is connected with a second rotating head, performing a CMP process by rotating the wafer while applying downward force to the wafer through the plurality of wafer holding cells, and unloading the vacuum force from the plurality of wafer holding cells when the CMP process is completed. In other words, the wafer holding cells 28 engage and hold the backside of the wafer 26 through a vacuum line 24 positioned at the center of the inner portion in order to prevent the wafer 26 from being derailed. The vacuum force from the plurality of wafer holding cells 28 is greater than the downward force 30. In order to apply the downward force 30 from the second rotating head 23 to the whole area of the wafer 26, the wafer holding cells 28 are substantially evenly distributed on the backside of the wafer 26. Thus, we expect to effectively improve uniformity within the wafer.

Preferably, the material for the plurality of wafer holding cells 28 comprises flexible rubber. The plurality of wafer holding cells 28 can hold and release the wafer 26 through the vacuum line 24 at the center of the inner portion. Also, the plurality of wafer holding cells 28 are uniformly positioned on the backside of the wafer 26 so that, unlike conventional polishing heads, the polishing head illustrated herein does not employ a retainer ring and/or a membrane in a polishing platen.

As the pressure applied to the wafer 26 is given to the uniformly arrayed plurality of wafer holding cells 28 through the air bag 22 disposed between the first rotating head 21 and the second rotating head 23, the quickly rotating surface of the wafer 26 is polished. The air bag 22 controls the pressure applied to the wafer 26. The wafer holding cells 28 can hold and release the wafer 26.

Figure 2D:
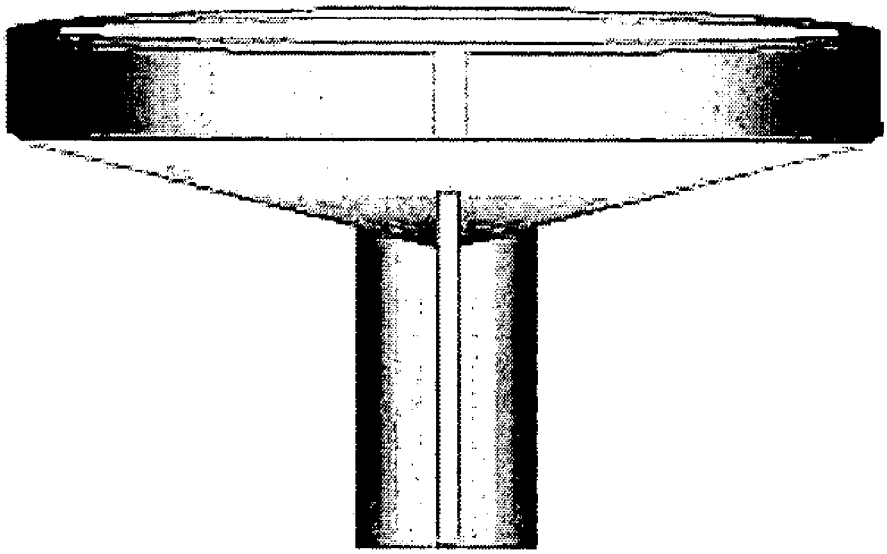

FIG. 2*d* schematically shows the reverse of FIG. 2*c*. Referring to FIG. 2*d*, the top view depicts the same pattern of the bottom surface of a wafer holding cell as FIG. 2*e*.

Figure 2E:
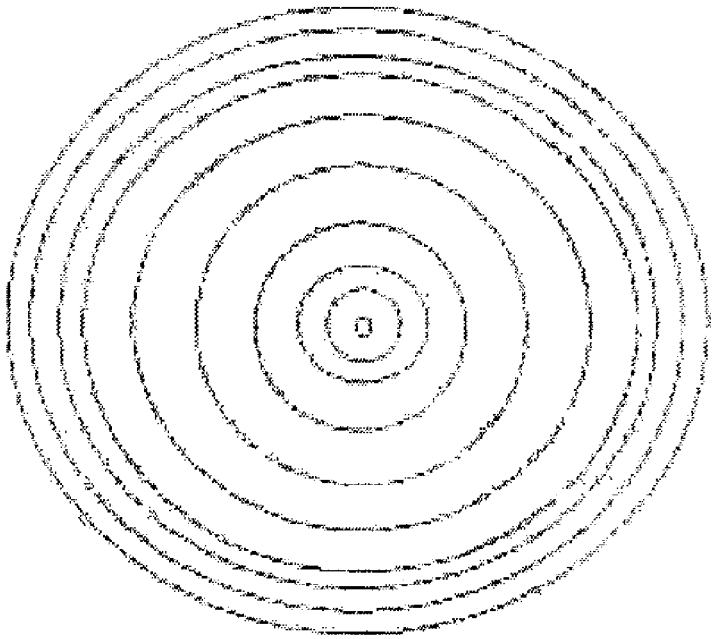

FIG. 2*e* schematically shows the pattern of the bottom surface of a wafer holding cell 28. Thus, looking up at the bottom surface of an example wafer holding cell 28 as in FIG. 2*e*, we see several concentric circles representative of a conical funnel.

The disclosed CMP polishing head and methods of use of the same reduce the substantial maintenance costs of consumables such as the retainer ring and membrane employed in prior art CMP polishing heads. In particular, the apparatus and methods disclosed herein avoid employing consumables such as the retainer ring and the membrane by providing the downward force used in polishing with an air bag while holding the wafer from the backside of the wafer with a vacuum.

From the foregoing, persons of ordinary skill in the art will appreciate that the above disclosed methods and apparatus reduce the enormous maintenance cost associated with prior art polishing heads by eliminating the retainer ring and membrane used in the prior art. Further, the above disclosed methods and apparatus achieve improved polishing uniformity of the surface of a wafer.

From the foregoing, persons of ordinary skill in the art will appreciate that the illustrated CMP polishing head holds and rotates a wafer with downward force to polish the surface of the wafer in a CMP process. The illustrated polishing head comprises a first rotating head to apply a downward force. The first rotating head is connected to a rotating axis. The illustrated polishing head also includes a second rotating head installed under and coupled with the first rotating head, an air bag positioned between the first and the second rotating heads to deliver the downward force from the first rotating head to the second rotating head, and a plurality of wafer holding cells to convey the downward force from the second rotating head to the wafer. The plurality of wafer holding cells is connected under the second rotating head and holds the wafer via a vacuum.

The illustrated CMP polishing head may be used by holding a wafer by vacuum force with a plurality of wafer holding cells, performing a CMP process by providing downward force through the plurality of wafer holding cells while rotating the wafer, and releasing the vacuum force from the plurality of wafer holding cells when the CMP process is completed. Each wafer holding cell is coupled to a vacuum line and is connected with a second rotating head.

It is noted that this patent claims priority from Korean Patent Application Serial Number 10-2003-0047495, which was filed on Jul. 12, 2003, and is hereby incorporated by reference in its entirety.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A CMP polishing head to polish the surface of a semiconductor wafer, comprising:

a first rotating head to apply a downward force, the first rotating head being rotatable by a rotating axis;

a second rotating head located under the first rotating head;

an air bag located between the first and second rotating heads to convey at least some of the downward force from the first rotating head to the second rotating head; and a plurality of wafer holding cells located under the second rotating head to hold the wafer via a vacuum force and to convey a least some of the downward force from the second rotating head to the wafer.

2. A CMP polishing head as defined in claim 1 further comprising a vacuum line coupled to at least one of the wafer holding cells to provide the vacuum force.

3. A CMP polishing head as defined in claim 1 wherein at least one of the wafer holding cells is made of flexible rubber.

4. A CMP polishing head as defined in claim 1 wherein at least one of the wafer holding cells comprises a holding end having a wider area than an end opposite the holding end.

5. A CMP polishing head as defined in claim 1 wherein at least one of the wafer holding cells has a funnel shape.

6. A CMP polishing head as defined in claim 5 wherein the at least one of the wafer holding cells has a substantially circular cross-section through the funnel shape.

* * * * *